US011399628B2

(12) United States Patent
Stearns et al.

(10) Patent No.: US 11,399,628 B2
(45) **Date of Patent: *Aug. 2, 2022**

(54) COLLAPSIBLE AND STACKABLE OUTDOOR STRUCTURE

(71) Applicant: MEDAL TECHNOLOGIES, LLC, Van Buren, OH (US)

(72) Inventors: Larry Stearns, Van Buren, OH (US); Michael Stearns, Van Buren, OH (US)

(73) Assignee: MEDAL TECHNOLOGIES, LLC, Van Buren, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/513,377

(22) Filed: Oct. 28, 2021

(65) Prior Publication Data

US 2022/0047074 A1 Feb. 17, 2022

Related U.S. Application Data

(63) Continuation of application No. 16/868,591, filed on May 7, 2020, now Pat. No. 11,166,549.

(60) Provisional application No. 62/844,180, filed on May 7, 2019.

(51) Int. Cl.
*E04B 1/343* (2006.01)
*A47B 87/02* (2006.01)

(52) U.S. Cl.
CPC ..... *A47B 87/0215* (2013.01); *E04B 1/34305* (2013.01); *A47B 87/0276* (2013.01)

(58) Field of Classification Search
CPC ... E04H 1/1216; E04H 1/1244; E04H 1/1222; E04H 1/1266; E04H 6/04; E04H 15/08; E04B 1/34305; E04B 1/3431; E04B 2001/34394; A47B 87/0215; A47B 87/0276
See application file for complete search history.

(56) References Cited

U.S. PATENT DOCUMENTS 2,944,852 A * 7/1960 Snyder ..... B60P 3/34 52/67
3,145,044 A 8/1964 Harrison et al.
3,960,161 A 6/1976 Norman
4,493,118 A 1/1985 Braxton
5,619,826 A * 4/1997 Wu ..... E04H 1/1216 52/35

(Continued)

*Primary Examiner* — Christine T Cajilig
(74) *Attorney, Agent, or Firm* — Jacob M. Ward; Ward Law Office LLC

(57) ABSTRACT

A portable structure has a main body and a plurality of telescopic beams. The main body includes a plurality of stacking modules. The plurality of stacking modules are configured to move between a collapsed position and an uncollapsed position. Each of the plurality of stacking modules has an inner surface and an outer surface. The plurality of stacking modules include a bottom stacking module and a top stacking module. The bottom stacking module is selectively and slidably disposed within the top stacking module. The top stacking module has a plurality of holes formed therethrough. The bottom stacking module is nested within the top stacking module, where the plurality of stacking modules are in the collapsed position. The bottom stacking module is unnested from the top stacking module, where the plurality of stacking modules are in the uncollapsed position.

18 Claims, 9 Drawing Sheets

(56) References Cited

U.S. PATENT DOCUMENTS

| | | | | |
|---|---|---|---|---|
| 6,151,840 | A * | 11/2000 | Simison | E04B 1/34305 52/123.1 |
| 10,538,908 | B1 * | 1/2020 | Wilson | E04B 1/34305 |
| 2004/0216395 | A1 * | 11/2004 | Wentworth, Jr. | B60P 3/34 52/79.5 |
| 2006/0260214 | A1 | 11/2006 | Tagg | |
| 2008/0209624 | A1 * | 9/2008 | Lavoie | E04H 1/1216 4/449 |
| 2013/0055499 | A1 * | 3/2013 | Miguel Serda | A47K 3/325 4/476 |
| 2013/0055604 | A1 * | 3/2013 | Herman Baran | A47B 45/00 40/606.03 |
| 2018/0106031 | A1 * | 4/2018 | Coombes | B66C 17/00 |
| 2019/0063090 | A1 * | 2/2019 | Schimmel | A47K 11/00 |
| 2019/0142231 | A1 * | 5/2019 | Nelson | A47K 11/026 4/483 |
| 2020/0386006 | A1 * | 12/2020 | Bikker | E04H 1/1216 |

* cited by examiner

COLLAPSIBLE AND STACKABLE OUTDOOR STRUCTURE

CROSS-REFERENCE TO RELATED APPLICATIONS

This application is a continuation application of U.S. patent application Ser. No. 16/868,591, filed on May 7, 2020, which in turn claims the benefit of U.S. Provisional Application No. 62/844,180, filed on May 7, 2019. The entire disclosures of the above applications are hereby incorporated herein by reference.

FIELD

The present disclosure relates to a portable structure and, more particularly, to a structure especially adapted for transport between locations and for outdoor use.

BACKGROUND

Buildings, defined as structures for human habitation or use, are among the largest man-made structures (only civil engineering works such as dams and bridges are larger). From the earliest history of construction, building techniques have been constrained by the structural and physical properties of available materials, the technology for shaping, finishing and joining materials together, and the means at hand for transporting, lifting, and putting the pieces of a building together. For thousands of years the essential technical and physical characteristics of buildings (stylistic differences aside) have generally remained the same.

A portable, demountable or transportable structure is a structure designed and built to be movable rather than permanently located. A common modern design is sometimes called a modular structure, but portable structures can be different in that they are more often used temporarily and taken away later.

Portable structures have various uses. They can typically be used alone or in groups, as temporary site offices on building sites. Other uses include guard shacks, in-plant offices, rural offices, on-site changing rooms, toilets etc.

Often, where portable structures are needed, the structures are assembled and transported fully assembled from location to location. Additionally, where the portable structures are assembled on site, significant assembly is still required. The assembly process may require many tools and loose pieces that can easily be lost during assembly, transport, and disassembly, or which may be simply installed improperly.

Some have tried to circumvent these shortcomings by providing portable structures, such as tents, that are easily assembled using cloth or another similar material. For example, U.S. Pat. No. 3,960,161 to Norman discloses a portable structure, which supports a fabric. However, undesirably, fabric materials may not be suitable for hash outdoor environments and may easily rip, tear or become disconnected.

Another known portable shelter is disclosed in U.S. Patent Appl. Pub. No. 2008/0209624 to Lavoie et al., and involves a collapsible enclosure that can be moved from a raised position to a lowered position. However, the Lavoie et al. structure may be difficult to lower and raise, and still inconveniently requires the use of additional tools for pushing or depressing snap buttons to disengage telescoping support posts of the structure.

There is a continuing need for a portable structure and method that is durable and easy to assemble and dismantle.

Desirably, the portable structure can be assembled and dismantled without requiring additional tools.

SUMMARY

In concordance with the instant disclosure, a portable structure and method that is durable and easy to assemble and dismantle, and which can be assembled and dismantled without requiring additional tools, has been surprisingly discovered.

This disclosure deals primarily with a portable, demountable, or transportable structure that is designed and built to be movable rather than permanently located.

In one embodiment, a portable structure has a main body and a plurality of telescopic beams. The main body includes a plurality of stacking modules. The plurality of stacking modules are configured to move between a collapsed position and an uncollapsed position. Each of the plurality of stacking modules has an inner surface and an outer surface. The plurality of stacking modules include a bottom stacking module and a top stacking module. The bottom stacking module is selectively and slidably disposed within the top stacking module. The top stacking module has a plurality of holes formed therethrough. The bottom stacking module is nested within the top stacking module, where the plurality of stacking modules is in the collapsed position. The bottom stacking module is unnested from the top stacking module, where the plurality of stacking modules are in the uncollapsed position. The plurality of telescopic beams are disposed inside the main body. Each of the plurality of telescopic beams has a bottom end and a top end. The bottom end is attached to the bottom stacking module. The top end is attached to the top stacking module. Each of the plurality of telescopic beams is further disposed through one of the plurality of holes of the top stacking module. The plurality of telescopic beams are configured to be placed in an unlocked position and a locked position. The plurality of telescopic beams in the unlocked position permit the plurality of stacking modules to be moved to the collapsed position. The plurality of telescopic beams in the locked position support the plurality of stacking modules in the uncollapsed position.

In another embodiment, a method for installing the portable structure includes the step of providing the portable structure. The portable structure has a main body and a plurality of telescopic beams. The main body includes a plurality of stacking modules. The plurality of stacking modules are configured to move between a collapsed position and an uncollapsed position. Each of the plurality of stacking modules has an inner surface and an outer surface. The plurality of stacking modules include a bottom stacking module and a top stacking module. The bottom stacking module is selectively and slidably disposed within the top stacking module. The top stacking module has a plurality of holes formed therethrough. The bottom stacking module is nested within the top stacking module, where the plurality of stacking modules is in the collapsed position. The bottom stacking module is unnested from the top stacking module, where the plurality of stacking modules are in the uncollapsed position. The plurality of telescopic beams are disposed inside the main body. Each of the plurality of telescopic beams has a bottom end and a top end. The bottom end is attached to the bottom stacking module. The top end is attached to the top stacking module. Each of the plurality of telescopic beams is further disposed through one of the plurality of holes of the top stacking module. The plurality of telescopic beams are configured to be placed in an unlocked position and a locked position. The plurality of telescopic beams in the unlocked position permit the plurality of stacking modules to be moved to the collapsed position. The plurality of telescopic beams in the locked position support the plurality of stacking modules in the uncollapsed position. Next, the portable structure is transported to the predetermined location where the plurality of stacking modules are in the collapsed position and the plurality of telescopic beams are in the unlocked position. Then, the portable structure is disposed on the predetermined location. Next, the top stacking module of the main body is moved upwardly. Then, the plurality of telescopic beams are placed in the locked position, thereby supporting the plurality of stacking modules in the uncollapsed position.

In a further embodiment, a portable structure has a main body. The main body includes a plurality of stacking modules. The plurality of stacking modules are configured to move between a collapsed position and an uncollapsed position. Each of the plurality of stacking modules has an inner surface and an outer surface. The plurality of stacking modules includes a bottom stacking module, a middle stacking module, and a top stacking module. The bottom stacking module is selectively and slidably disposed within the middle stacking module. The middle stacking module is selectively and slidably disposed within the top stacking module. The middle stacking module has ridges formed on the outer surface and the top stacking has corresponding channels formed on the inner surface. The bottom stacking module is nested within the middle stacking module and the middle stacking module is nested within the top stacking module, where the plurality of stacking modules are in the collapsed position. The bottom stacking module is unnested from the middle stacking module and the middle stacking module is unrested from the top stacking module, where the plurality of stacking modules are in the uncollapsed position.

In an exemplary embodiment, a portable structure has a main body with a plurality of stacking portions. The main body is adapted to alternate between an expanded position and a collapsed position.

In particular embodiments, the portable structure may be formed from a lightweight plastic material such as a polypropylene plastic material, by a molding process such as injection molding, as nonlimiting examples. It should be understood, the main body may be formed from any other suitable material, including other thermoplastic materials such as polyethylene, for example, and non-thermoplastic materials such as foam or metal, for example. Any suitable processes for forming the portable structure may also be employed, as desired.

In further embodiments, the stacking portions may each be adapted to slidably connect with an opposing stacking portion. For example, at least one protrusion disposed on one stacking portion may be configured to connect with at least one aperture formed on an opposing stacking portion. In certain embodiments, the at least one protrusion may be a plurality of protrusions, and the at least one aperture may be a plurality of apertures. In a further example, each stacking portion may have a top end and a bottom end, where the protrusions on the top end of each stacking portion may be adapted to connect with apertures on the bottom end of the opposing stacking portion. Nonetheless, it should be appreciated that the stacking portions may be slidably connected to the opposing stacking portions by a variety of methods chosen by one skilled in the art, including but not limited to snaps, straps, hook and loop fasteners, screws and bolts.

The stacking portions may also have at least one ridge disposed thereon. In certain embodiments the at least one ridge includes a plurality of ridges. The ridge of one stacking portion may be adapted to fit within the ridge of an opposing stacking portion. Advantageously, the ridge militates against a disconnection of one stacking portion from another stacking portion.

In a further non-limiting example, each stacking portion may be U-shaped, and each U-shaped stacking portion may have a first side wall, a second side wall and a third side wall. Nonetheless, it should be appreciated that the stacking portions may be any shape chosen by a skilled artisan, as desired. For example, the stacking portions may be hexagonal, rectangular or trapezoidal.

In a most particular embodiment, the main body of the portable structure may include a first stacking portion, a second stacking portion, a third stacking portion, a base and a cap. However, it should be appreciated that any number of stacking portions may be chosen by one skilled in the art, as desired.

In a further embodiment, the first stacking portion may surround a flange that protrudes from the base of the main body. It should be appreciated that the first stacking portion surrounding the flange formed in the base militates against an undesirable falling of the portable structure.

The second stacking portion may be adapted to surround the first stacking portion, where the portable structure is in the expanded position and the collapsed position. Additionally, the third stacking portion may be adapted to surround the second stacking portion in the expanded position and may surround both the first stacking portion and the second stacking portion in the collapsed position.

The first stacking portion may have protrusions adjacent to the top end and the second stacking portion may have apertures adjacent to the bottom end. The protrusions of the first stacking portion are adapted to fit within the apertures of the second stacking portion, where the main body is in the expanded position. The second stacking portion may also have protrusions adjacent to the top end and the third stacking portion may have apertures adjacent to the bottom end. The protrusions disposed on the second stacking portion are adapted to fit within apertures formed in the third stacking portion, where the main body is in the expanded position.

The second stacking portion and the third stacking portion may each have at least one ridge. In non-limiting example, the at least one ridge may be two ridges formed in the first side wall and two ridges formed in the third sidewall of the second stacking portion and the third stacking portion. However, it should be appreciated that any number of ridges may be chosen by one skilled in the art. Additionally, it should also be appreciated that the ridges may be disposed in any location on each stacking portion, as desired.

In a further embodiment, the ridges may be tapered where a portion of the ridge adjacent to the bottom end of the stacking portion has a depth that is less than a depth of a portion of the ridge adjacent to the top end of the stacking portion.

For example, the ridges of the second stacking portion may be tapered where a portion of the ridge adjacent to the bottom end of the second stacking portion has a depth that is less than a depth of a portion of the ridge adjacent to the top end of the second stacking portion.

In a most particular embodiment, the ridges of the second stacking portion are configured to fit within the ridges of the third stacking portion. It should be appreciated that the tapering of the ridge on the second stacking portion is adapted to facilitate a sliding of the third stacking portion over the ridge of the second stacking portion. In particular, the tapering of the ridge is adapted to facilitate a transfer of the stacking portions from an area of high friction (where the stacking portions are in the collapsed position) to an area of low friction (where the stacking portions are in the expanded position). The ridges of the second stacking portion and the third stacking portion are each adapted to militate against an unintended disconnection of the second stacking portion from the third stacking portion. In a further example, the ridge formed in third stacking portion may be planar and substantially parallel to the side wall disposed thereon.

In further embodiments, the cap is attached to the top end of the third stacking portion. The cap is adapted to protect the main body from outdoor weather conditions. For example, the cap may have a domed portion to militate against water pooling on a roof of the portable structure. Other suitable structures for the cap may also be employed.

In yet further embodiments, each stacking portion may have three sidewalls forming an opening in the main body. Where there is an opening formed in the expanded main body, a door may be installed thereon. For example, the door may be modular and may include a plurality of door panels. Each door panel may be adapted to connect with an opposing door panel, as well as the portable structure where in the expanded position.

For example, each door panel may have a first side and a second side. The first side of the panel may have a node and the second side of the door panel may have recess. The node of each door panel is adapted to fit within the recess of the opposing door panel. In a most specific embodiment, the node of the top most panel may be configured to fit within the recess formed in the cap and the recess of the bottom most panel may be adapted to receive the node formed in the base. Nonetheless, the door may be hingedly attached to the expanded main body by any method as chosen by one skilled in the art.

In operation, where the portable structure is to be expanded for end use, the user may transport the portable structure to the desired location. The third stacking portion may be moved upwards relative to the second stacking portion, until the protrusions formed in the second stacking portion are disposed in the apertures of the third stacking portion. The second stacking portion is then moved upwards relative the first stacking portion, until the protrusions of the first stacking portion are disposed in the apertures of the second stacking portion. The door may then be attached to the main body adjacent to the opening formed therein. The portable structure is now ready for use.

Also, in operation, where the portable structure is to be collapsed for storage or transport, the user may collapse the portable structure by first removing the door from the main body. The protrusions disposed on the first stacking portion may then be pushed inward, disconnecting the protrusions from the second stacking portion. The second stacking portion is then lowered so the second stacking portion surrounds the first stacking portion and the bottom end of the second stacking portion abuts the base of the portable structure. The protrusions disposed on the second stacking portion are then be pushed inward, disconnecting the protrusions from the apertures of the third stacking portion. The third stacking portion is then lowered so the third stacking portion surrounds the first and second stacking portions and the bottom end of the third stacking portion abuts the base of the portable structure. The portable structure is now in the collapsed position.

Advantageously, the portable structure described hereinabove is easy to construct and durable. It should be further appreciated that the portable structure may be quickly moved by hand between a raised and lowered position for use outdoors in a variety of applications, and without requiring the use of additional tools.

Further areas of applicability will become apparent from the description provided herein. It should be understood that the description and specific examples are intended for purposes of illustration only and are not intended to limit the scope of the present disclosure.

DRAWINGS

The above, as well as other advantages of the present disclosure, will become readily apparent to those skilled in the art from the following detailed description, particularly when considered in the light of the drawings described herein.

DETAILED DESCRIPTION

Figure 1:
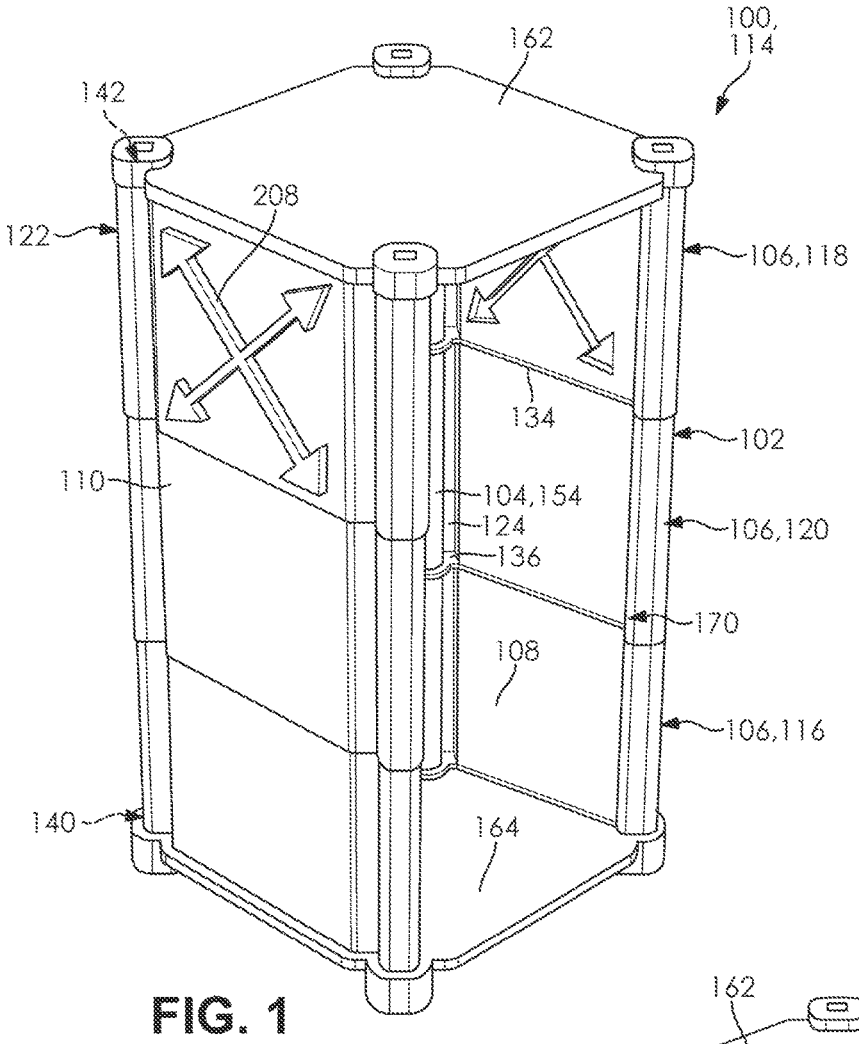
FIG. 1 is a top perspective view of a portable structure, according to one embodiment of the disclosure, and further showing the portable structure in an uncollapsed position.

The following detailed description and appended drawings describe and illustrate various embodiments of the invention. The description and drawings serve to enable one skilled in the art to make and use the invention and are not intended to limit the scope of the invention in any manner. In respect of the methods disclosed, the order of the steps presented is exemplary in nature, and thus, is not necessary or critical unless otherwise disclosed.

As used herein, the term "structure" may include any enclosure that can used for human habitation, storage, or for personal hygiene activities. However, it should be appreciated that other uses for the enclosure are contemplated and may therefore be included within the scope of this disclosure.

As used herein, the term "portable" refers to the ability for the structure to be put in a state that allows for the structure to be easily transported by hand or by vehicle.

As shown in FIGS. 1-5, a portable structure 100 has a main body 102 and a plurality of telescopic beams 104. The main body 102 is configured to function as an enclosure. Non-limiting examples include an enclosure for personal belongings, an outhouse, or a sleeping pod. However, it should be appreciated that a skilled artisan may use the main body 102 for other suitable purposes, as desired.

In some examples, the main body 102 is manufactured from plastic. Although, it should be appreciated that one skilled in the art may manufacture the main body 102 from other suitable materials, such as metal or wood, within the scope of this disclosure.

While still referring to FIGS. 1-5, the main body 102 may also include a plurality of stacking modules 106 with an inner surface 108 and an outer surface 110. The plurality of stacking modules 106 are configured to move between a collapsed position 112 and an uncollapsed position 114. Desirably, the collapsed position 112 permits the portable structure 100 to be easily moved to a predetermined location, while the uncollapsed position 114 allows the portable structure 100 to be used. It should be appreciated that a person skilled in the art may employ additional positions, such as a partially uncollapsed position (not shown) that would allow only a portion of the main body 102 to be used, as desired.

The plurality of stacking modules 106 may include a bottom stacking module 116 and a top stacking module 118. The bottom stacking module 116 is selectively and slidably disposed within the top stacking module 118.

Figure 5:
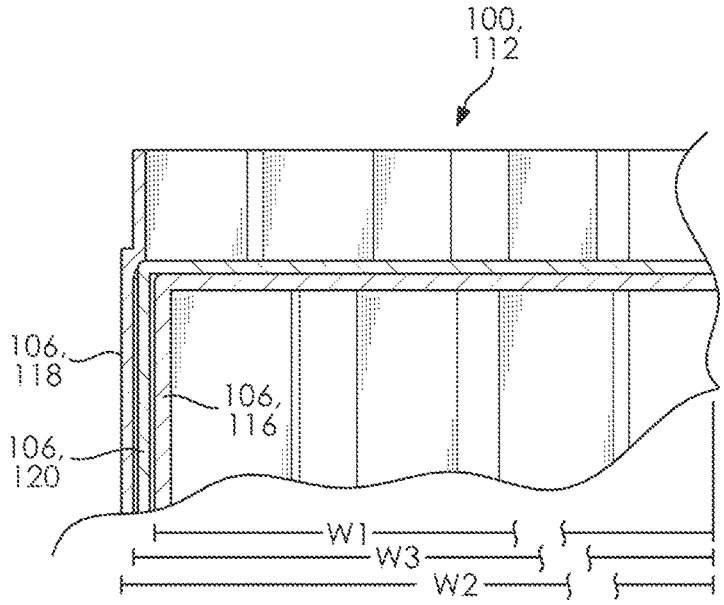
FIG. 5 is a cross sectional side elevational view of the portable structure in the collapsed position with the top cap removed and taken at section line A-A in FIG. 2, and further showing a bottom stacking module and a middle stacking module nested within a top stacking module.

In particular examples, the bottom stacking module 116 has a width W1 and the top stacking module 118 has a width W2, as shown in FIG. 5. The width W1 of the bottom stacking module 116 is less than the width W2 of the top stacking module 118, thereby allowing the bottom stacking module 116 to be slidably disposed within the top stacking module 118. Advantageously, this permits the portable structure 100 to be selectively moved from the collapsed position 112 to the uncollapsed position 114.

Referring back to FIGS. 1-5, the plurality of stacking modules 106 may also include a middle stacking module 120. The middle stacking module 120 is disposed between the bottom stacking module 116 and the top stacking module 118. The middle stacking module 120 is selectively and slidably disposed within the top stacking module 118 and the bottom stacking module 116 is selectively and slidably disposed within the middle stacking module 120.

As shown in FIG. 5, the middle stacking module 120 has a width W3. The width W3 of the middle stacking module 120 is greater than the width W1 of the bottom stacking module 116. In addition, the width W3 of the middle stacking module 120 is less than the width W2 of the top stacking module 118. Desirably, this allows the portable structure 100 to be selectively moved from the collapsed position 112 to the uncollapsed position 114, even with additional stacking modules. It should be appreciated a skilled artisan may scale the number of the plurality of stacking modules 106, within the scope of this disclosure.

Figure 2:
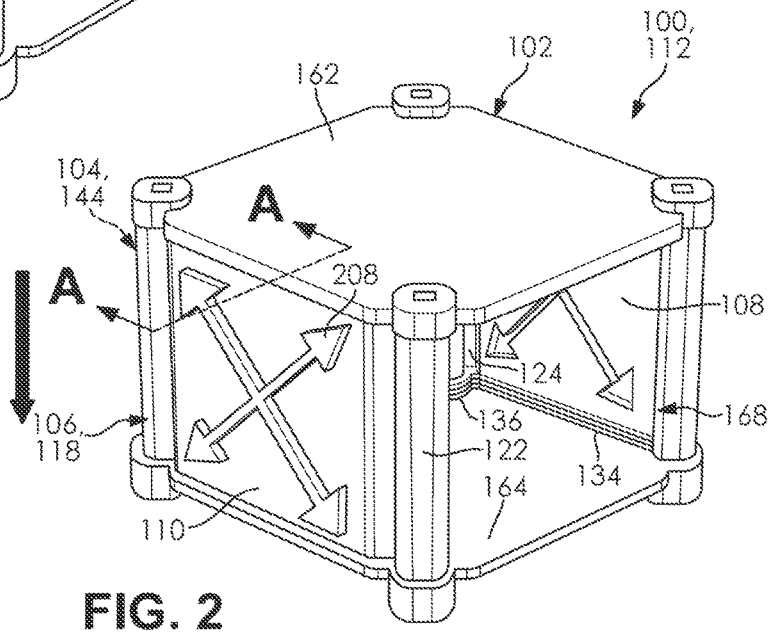
FIG. 2 is a top perspective view of the portable structure shown in FIG. 1, and further showing the portable structure in a collapsed position.
Figure 3:
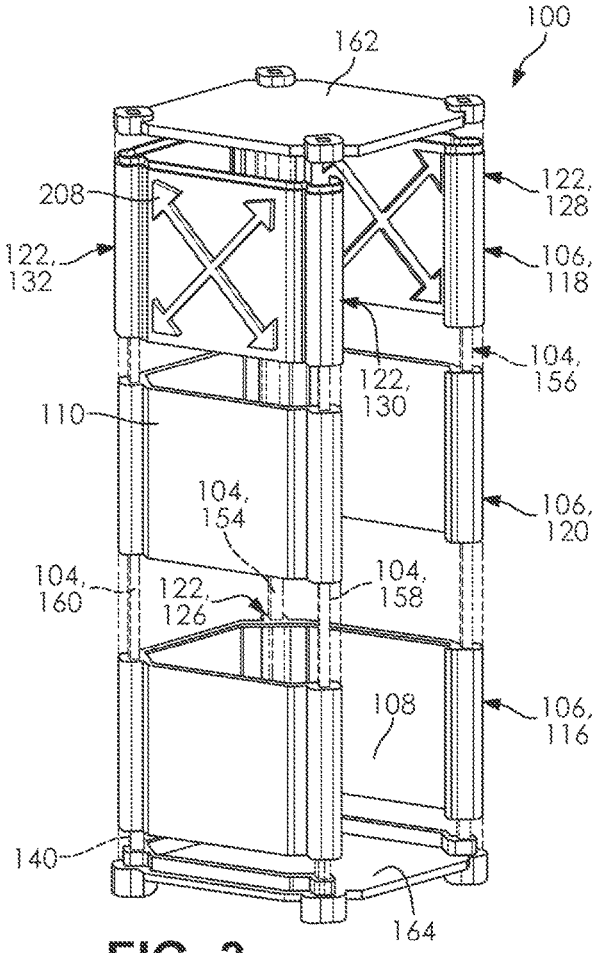
FIG. 3 is an exploded view of the portable structure shown in FIG. 1, and further showing a plurality of telescopic beams, a top cap, and a bottom cap.

As shown in FIG. 2, where the portable structure 100 is in the collapsed position 112, the bottom stacking module 116 is nested within the middle stacking module 120 and the middle stacking module 120 is nested within the top stacking module 118. Advantageously, the portable structure 100 in the collapsed position 112 has a smaller size factor and is easily transportable. In addition, a user may stack multiple portable structures 100 in the collapsed position 112 on top of each other for convenient storage.

Now referring to FIG. 1, where the portable structure 100 is in the uncollapsed position 114, the bottom stacking module 116 is unnested from the middle stacking module 120 and the middle stacking module 120 is unnested from the top stacking module 118. Desirably, this allows the portable structure 100 to function as an enclosure for different purposes, such as an outhouse or storage.

With reference to FIGS. 1-5, each of the plurality of stacking modules 106 may include a plurality of corners 122. Each of the plurality of corners 122 has a corner channel 124 formed on the inner surface 108 of each of the plurality of stacking modules 106. The corner channel 124 of each of the plurality of corners 122 are configured to receive one of the plurality of telescopic beams 104. Without being bound to a particular belief, it is believed that having one of the plurality of telescopic beams 104 disposed in each corner channel 124 of the plurality of corners 122 permits the portable structure 100 to have greater structural integrity.

In specific examples, the plurality of corners 122 includes a first corner 126, a second corner 128, a third corner 130, and a fourth corner 132. While this number of the plurality of corners 122 has been shown to be useful, it should be appreciated that one skilled in the art may scale the number of the plurality of corners 122, as desired.

Figure 4:
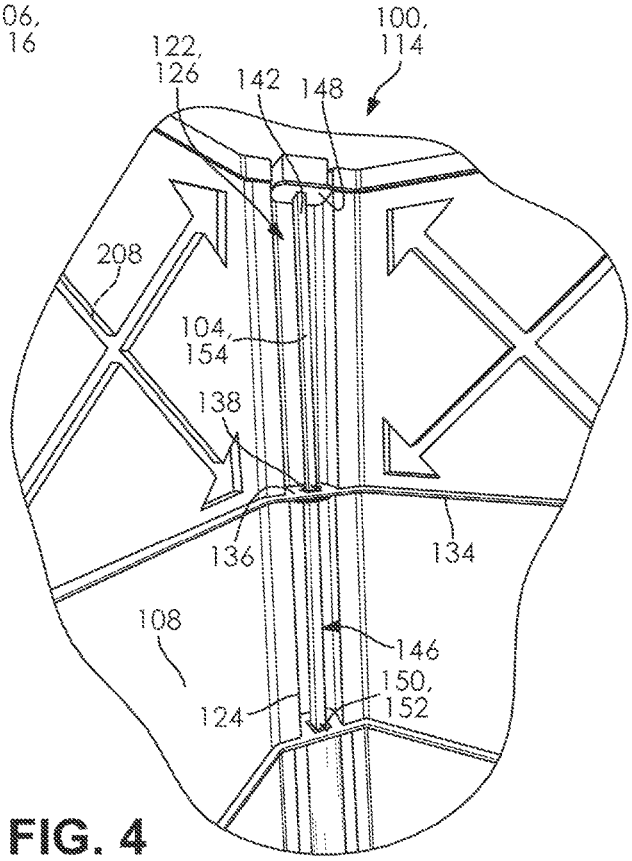
FIG. 4 is front perspective of an interior of the portable structure shown in FIG. 1, and further showing a plurality of ribs, a telescopic post, and a plurality of bridge segments.

Now referencing FIG. 4, the top stacking module 118 and the middle stacking module 120 may include a rib 134. The rib 134 of the top stacking module 118 may be disposed on the inner surface 108 of the top stacking module 118. The rib 134 of the middle stacking module 120 may be disposed on the inner surface 108 of the middle stacking module 120.

While still referring to FIG. 4, the rib 134 of each of the top stacking module 118 and the middle stacking module 120 may have a plurality of bridge segments 136. Each of the plurality of bridge segments 136 is disposed across the corner channel 124 of each of the plurality of corners 122. Each of the plurality of bridge segments 136 may include a hole 138 formed therethrough. The hole 138 of each of the plurality of bridge segments 136 are configured to receive one of the plurality of telescopic beams 104.

With reference to FIGS. 1-4, the plurality of telescopic beams 104 are disposed inside of the main body 102. In specific examples, one of the plurality of telescopic beams 104 is disposed in the corner channel 124 of each of the plurality of corners 122. In more specific examples, one of the plurality of telescopic beams 104 is disposed in the corner channel 124 of each of the plurality of corners 122 and through the hole 138 of each of the plurality of bridge segments 136. Without being bound to a particular belief, it is believed this configuration permits for the portable structure 100 to have greater structural integrity. However, it should be appreciated that a skilled artisan may employ other configurations of the plurality of telescopic beams 104, within the scope of this disclosure.

As shown in FIGS. 1, 3-4, and 16, each of the plurality of telescopic beams 104 has a bottom end 140 and a top end 142. The bottom end 140 of each of the plurality of telescopic beams 104 is attached to the bottom stacking module 116. The top end 142 of each of the plurality of telescopic beams 104 is attached to the top stacking module 118. Advantageously, this allows each of the plurality of telescopic beams 104 to be pulled upwardly where the user moves the top stacking module 118 upwardly to the uncollapsed position 114.

The plurality of telescopic beams 104 are configured to be placed in an unlocked position 144 and a locked position 146. The unlocked position 144 permits the plurality of telescopic beams 104 to be moveable, thereby allowing the plurality of stacking modules 106 to shift between the uncollapsed position 114 and the collapsed position 112. The locked position 146 militates against the plurality of telescopic beams 104 from being moveable, thereby militating against the plurality of stacking modules 106 from being able to shift between the uncollapsed position 114 and the collapsed position 112. Desirably, the locked position 146 supports the plurality of stacking modules 106 and militates against the portable structure 100 from moving into the collapsed position 112 where the user is using the portable structure 100 in the uncollapsed position 114.

Figure 17:
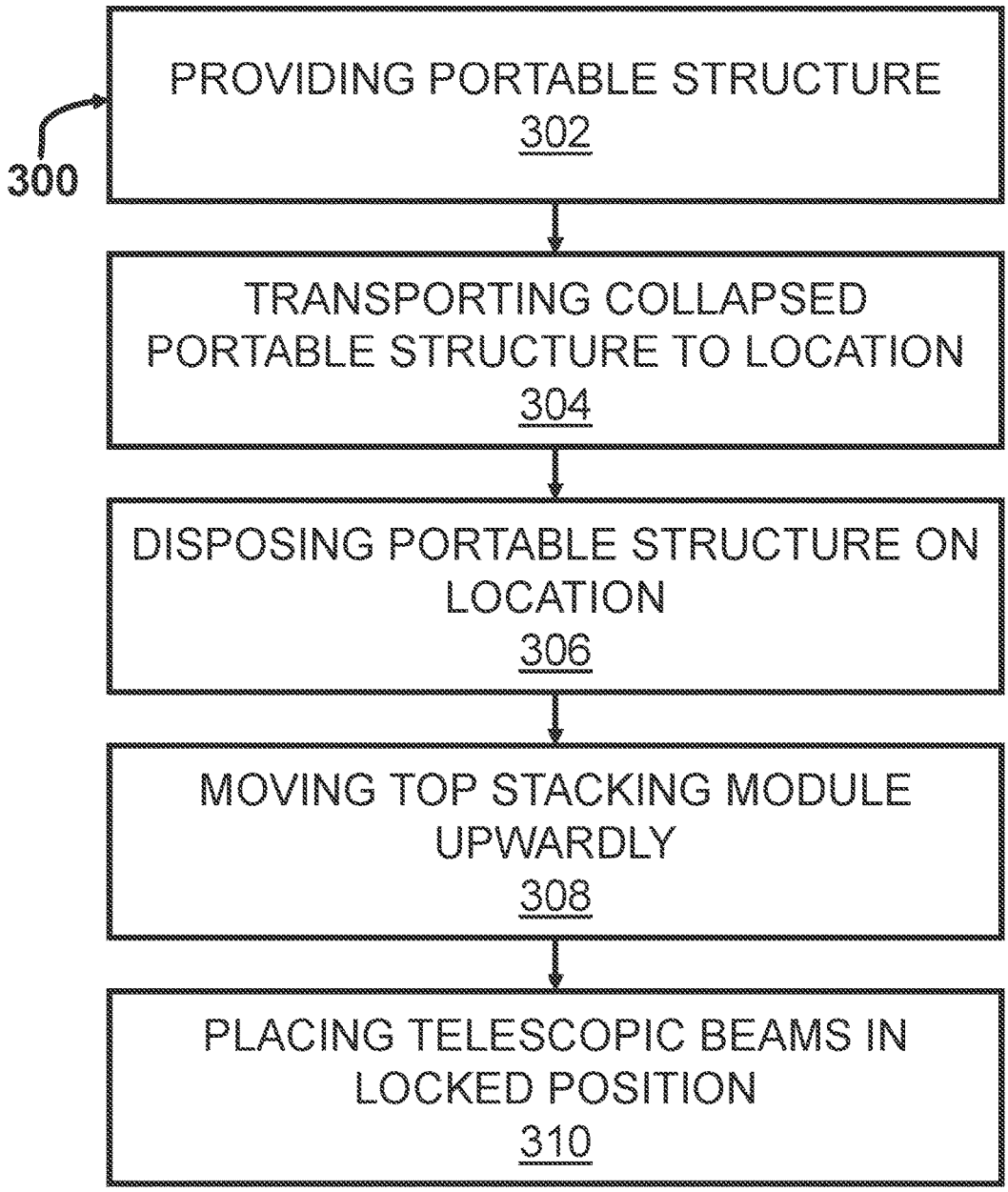
FIG. 17 is a flowchart showing a method for installing the portable structure shown in FIGS. 1-5, according to one embodiment of the disclosure.

Now referring to FIGS. 4 and 17, each of the plurality of telescopic beams 104 may have at least one shelf 148. The shelf 148 of each of the plurality of telescopic beams 104 is disposed below each of the plurality of bridge segments 136. The shelf 148 is configured to support one of the plurality of bridge segments 136 where the plurality of stacking modules 106 is in the uncollapsed position 114. Advantageously, the shelf 148 militates against the plurality of stacking modules 106 from moving to the collapsed position 112 from the uncollapsed position 114.

While still referring to FIGS. 4 and 17, each of the plurality of telescopic beams 104 may have at least one locking aperture 150. The locking aperture 150 of each of the plurality of telescopic beams 104 is disposed above one of the plurality of bridge segments 136. The locking aperture 150 is configured to receive a locking pin 152. The locking pin 152 is configured to permit each of the plurality of telescopic beams 104 to be placed in the locked position 146 where the locking pin 152 is disposed in the locking aperture 150. Desirably, the locking pin 152 where disposed in the locking aperture 150 militates against the plurality of telescopic beams 104 from moving to the unlocked position 144, and thereby militating against the plurality of stacking modules 106 from moving to the collapsed position 112. It should be appreciated that a one skilled in the art may employ other methods of locking to place the plurality of telescopic beams 104 into the locked position 146.

In particular embodiments, the plurality of telescopic beams 104 include a first telescopic beam 154, a second telescopic beam 156, a third telescopic beam 158, and a fourth telescopic beam 160. The first telescopic beam 154 is disposed through the corner channel 124 of the first corner 126. The second telescopic beam 156 is disposed through the corner channel 124 of the second corner 128. The third telescopic beam 158 is disposed through the corner channel 124 of the third corner 130. The fourth telescopic beam 160 is disposed through the corner channel 124 of the fourth corner 132. Without being bound to a particular belief, it is believed that this configuration of the plurality of telescopic beams 104 and the plurality of corners 122 allows for the portable structure 100 to have greater structural integrity. However, it should be appreciated that a skilled artisan may employ other configurations, within the scope of this disclosure.

Now referring to FIGS. 1-4, the main body 102 of the portable structure 100 may further include a top cap 162 and a bottom cap 164. The top cap 162 is configured to act as the roof of the main body 102. The top cap 162 is disposed on the top stacking module 118. In particular examples, the top end 142 of each of the plurality of telescopic beams 104 is attached to the top cap 162 of the main body 102, thereby attaching each of the plurality of telescopic beams 104 to the top stacking module 118 via the top cap 162.

The bottom cap 164 is configured to function as the floor of the main body 102. The bottom cap 164 supports the bottom stacking module 116. In particular examples, the bottom end 140 of each of the plurality of telescopic beams 104 is attached to the bottom cap 164 of the main body 102, thereby attaching each of the plurality of telescopic beams 104 to the bottom stacking module 116 via the bottom cap 164.

With reference to FIG. 1, each of the plurality of stacking modules 106 has a front opening 168. The front opening 168 of each of the plurality of stacking modules 106 together define a doorway 170, where the plurality of stacking modules 106 is in the uncollapsed position 114.

Figure 8:
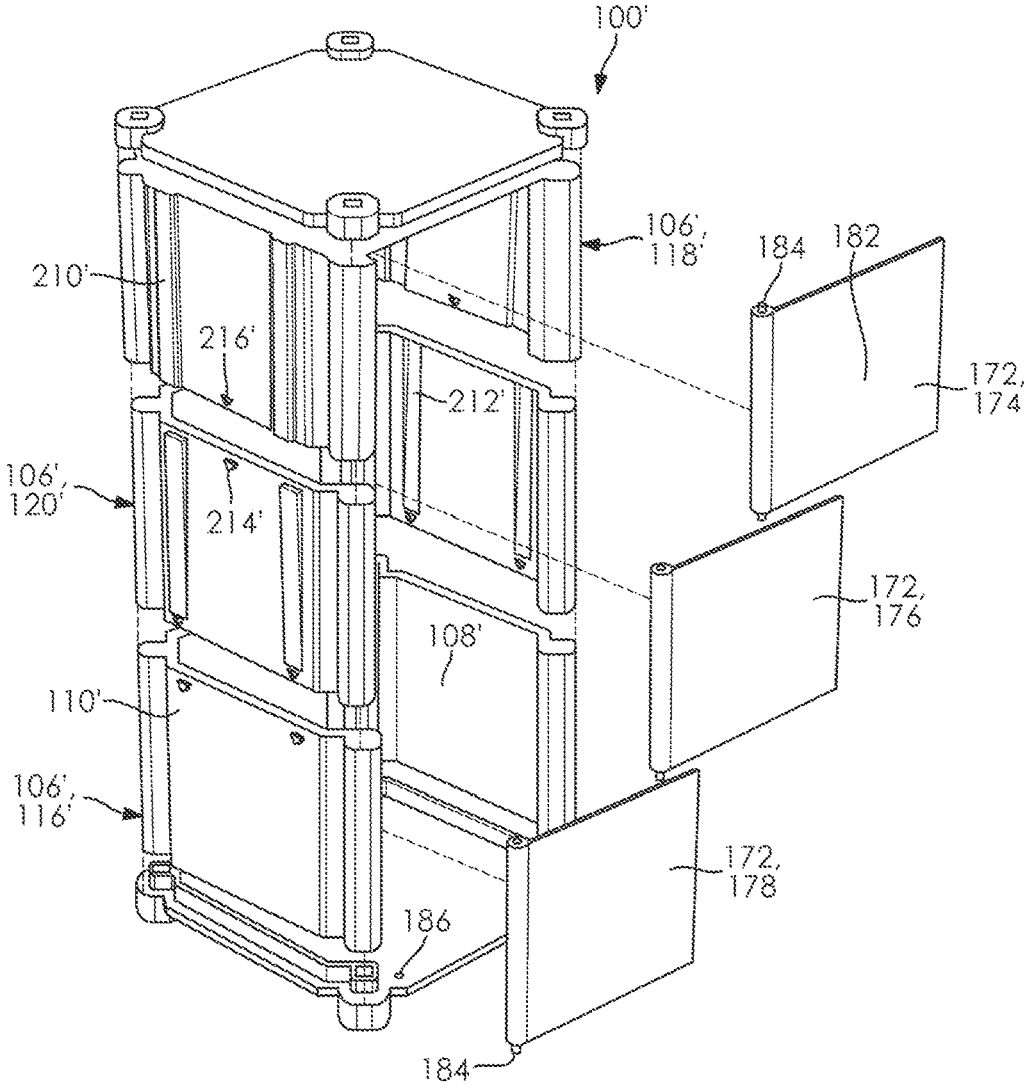
FIG. 8 is an exploded view of the portable structure shown in FIG. 6, and further showing a door with a top panel, a middle panel, and a bottom panel.

As shown in FIGS. 11-15 (and also in certain embodiments shown in FIG. 8, which are described further hereinbelow), the main body 102 also has a door 172. The door 172 may include a top panel 174, a middle panel 176, and a bottom panel 178. Each of the top panel 174, the middle panel 176, and the bottom panel 178 has a door inner surface 180 and a door outer surface 182.

With further reference to FIGS. 11-15, the top panel 174 may be selectively and removably affixed to the middle panel 176. The middle panel 176 may be selectively and removably affixed to the to the bottom panel 178. The top panel 174 may be removably and rotatably affixed to the top cap 162. The bottom panel 178 may be removably and rotatably affixed to the bottom cap 164. Desirably, this permits the door 172 to close and open the doorway 170, as shown in FIG. 1.

In particular examples, the top panel 174 and the bottom panel 178 may have a door protrusion 184. In addition, top cap 162 and bottom cap 164 may have a door aperture 186. The door aperture 186 is configured to receive the door protrusion 184, thereby allowing the door to open and close. In other instances, the top panel 174 of the door 172 is attached to the top stacking module 118 via a hinge 187. It should be appreciated that a skilled artisan may employ other methods of attaching the door 172 to the main body 102.

With reference to FIGS. 11-15, the door 172 is configured to move to an extended position 188 where the plurality of stacking modules 106 are in the uncollapsed position 114. Also, the door 172 is further configured to move to an unextended position 190 where the plurality of stacking modules 106 are in the collapsed position 112. Desirably, this removes the step of attaching the door 172 to the portable structure 100 where the portable structure 100 is moved to the uncollapsed position 114 and removing the door 172 before the portable structure 100 is moved to the collapsed position 112.

Figure 11:
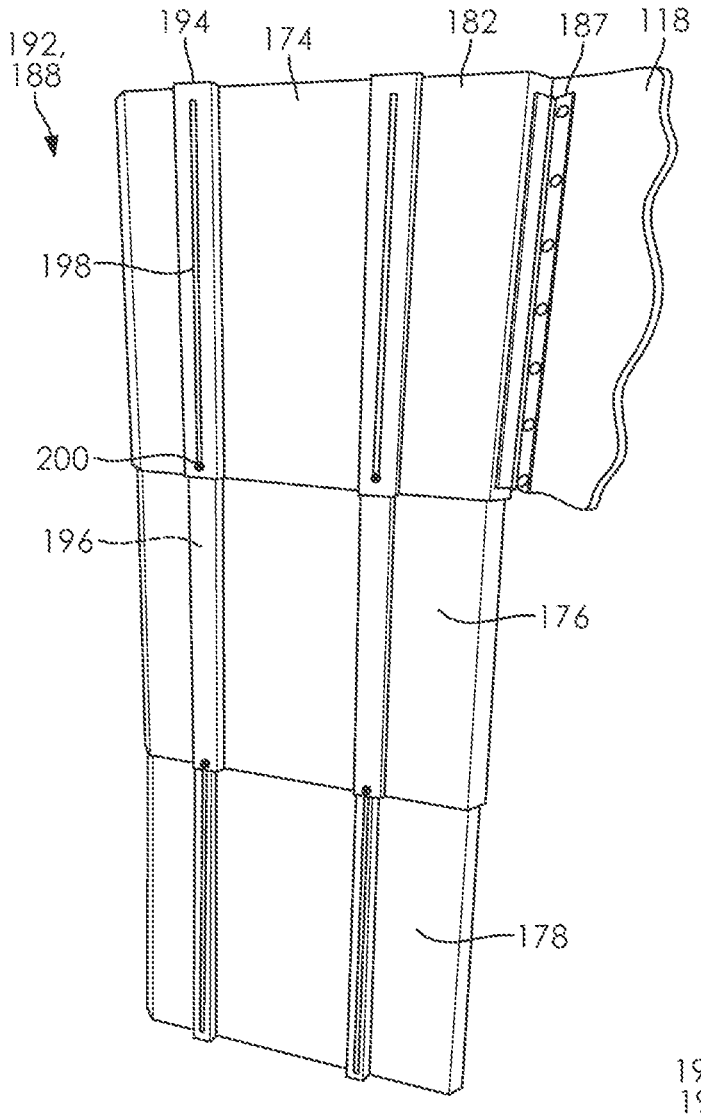
FIG. 11 is a front perspective view of a sliding door for the portable structure, according to one embodiment of the disclosure, and further showing the door in an extended position.
Figure 12:
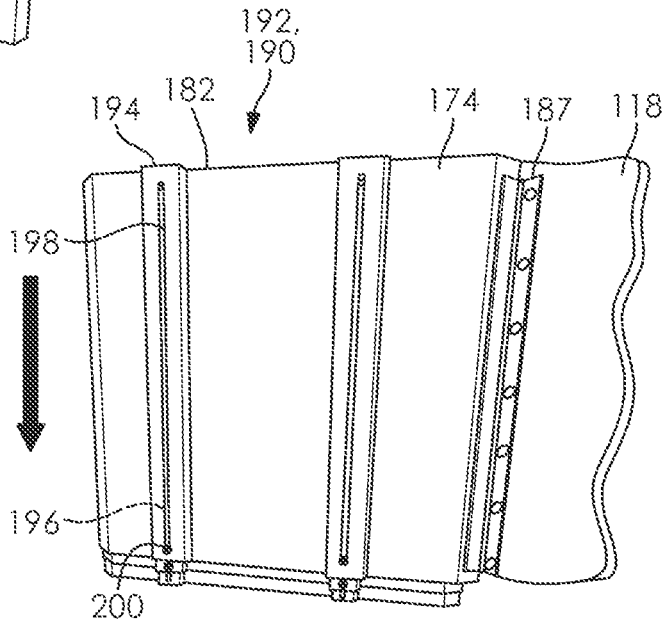
FIG. 12 is a front perspective view of the sliding door shown in FIG. 11, and further showing the door in an unextended position.

Now referring to FIGS. 11-12, the door 172 may be a sliding door 192. The sliding door 192 has the middle panel 176 slidably disposed in the top panel 174. Also, the bottom panel 178 is slidably disposed in the middle panel 176.

As shown in FIG. 12, the middle panel 176 is nested within the top panel 174 and the bottom panel 178 is nested within the middle panel 176, where the sliding door 192 is in the unextended position 190. Desirably, this allows the sliding door 192 to move to the unextended position 190 as the plurality of stacking modules 106 are moved to the collapsed position 112.

With reference to FIG. 11, the middle panel 176 is unnested from the top panel 174 and the bottom panel 178 is unnested from the middle panel 176 where the sliding door 192 is in the extended position 188. Advantageously, this permits the sliding door 192 to move to the extended position 188 as the plurality of stacking modules 106 are moved to the uncollapsed position 114.

In particular examples, each of the top panel 174, the middle panel 176, and the bottom panel 178 include at least one door ridge 194 with a corresponding door channel 196. The door ridge 194 of the middle panel 176 is disposed within the corresponding door channel 196 of the top panel 174. The door ridge 194 of the bottom panel 178 is disposed within the corresponding door channel 196 of the middle panel 176.

The door ridge 194 of each of the top panel 174 and the bottom panel 178 also have one track 198 with a door fastener 200. The door fastener 200 of the top panel 174 is disposed through the top panel 174 and the middle panel 176, thereby permitting the middle panel 176 to slidably move along the track 198 of the top panel 174. The door fastener 200 of the bottom panel 178 is disposed through the middle panel 176 and the bottom panel 178, thereby allowing the middle panel 176 slidably move along the track 198 of the bottom panel 178.

Figure 13:
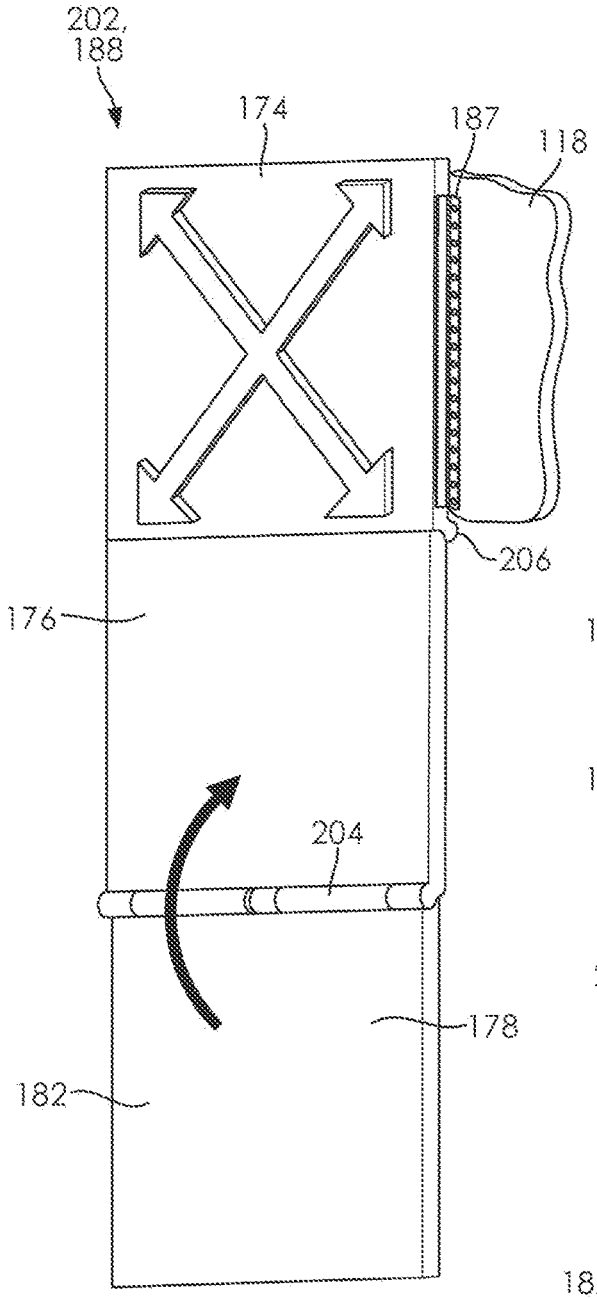
FIG. 13 is a front perspective view of a hinged door for the portable structure, according to one embodiment of the disclosure, and further showing the hinged door in an extended position.
Figure 14:
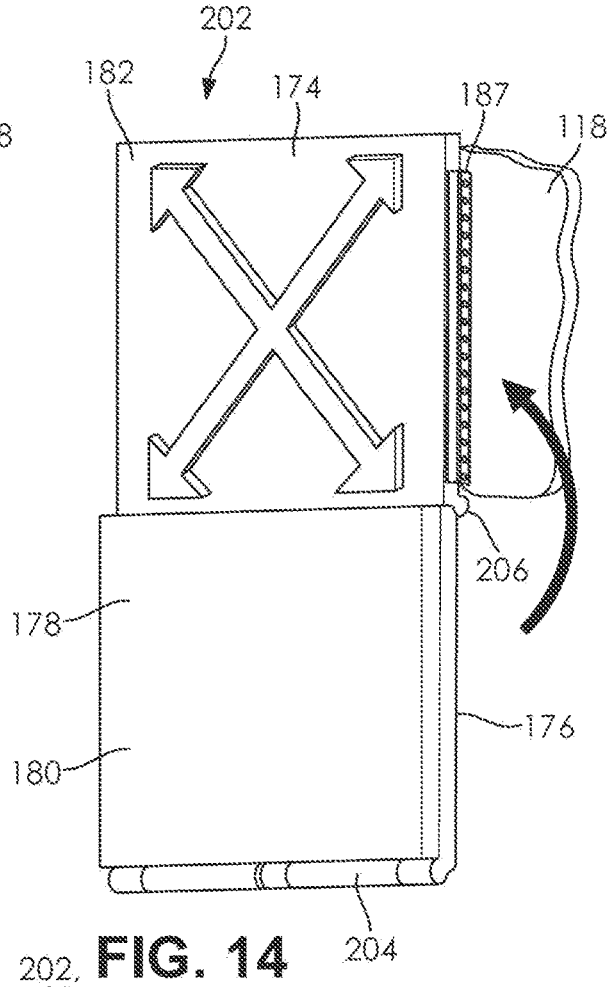
FIG. 14 is a front perspective view of the hinged door shown in FIG. 13, and further showing a bottom panel pivoted upwardly and adjacent to a middle panel.
Figure 15:
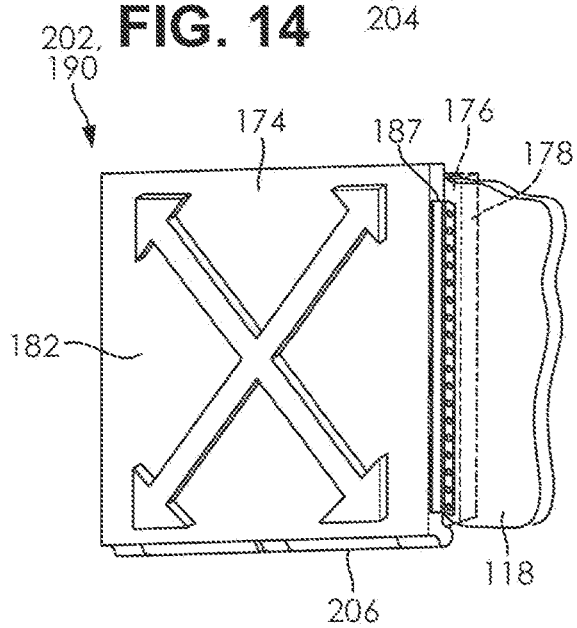
FIG. 15 is a front perspective view of the hinged door shown in FIG. 13, and further showing the middle panel pivoted upwardly and behind a top panel.
Figure 16:
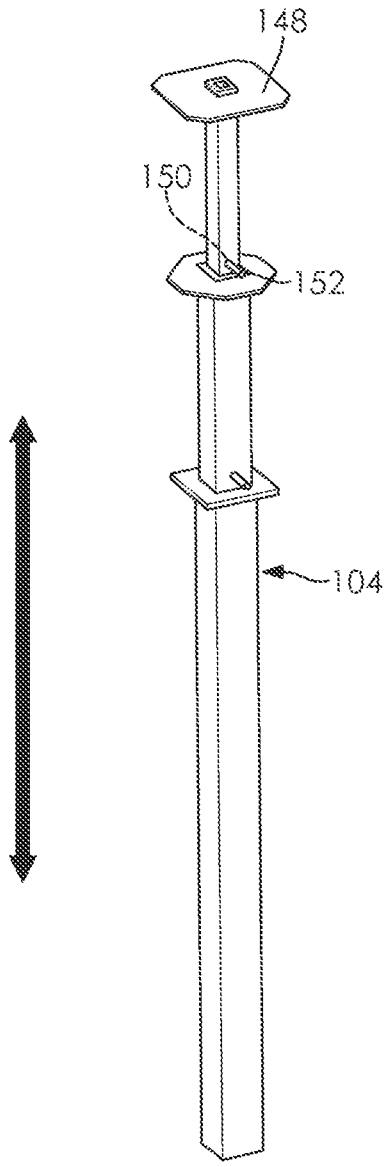
FIG. 16 is a front perspective view of one of the plurality of telescopic beams shown in FIGS. 3-4.

Now referring to FIGS. 13-14, the door 172 may be a hinged door 202. The hinged door 202 has the middle panel 176 hingedly attached to the bottom panel 178 via a bottom hinge 204. Also, the top panel 174 is hingedly attached to the middle panel 176 via a top hinge 206.

The bottom panel 178 is configured to pivot about the bottom hinge 204 so that the door outer surface 182 of the bottom panel 178 is adjacent to and faces the door outer surface 182 of the middle panel 176, where the hinged door 202 is in the unextended position 190, as shown in FIG. 14. In addition, the middle panel 176 is configured to pivot about the top hinge 206 so that the door inner surface 180 of the middle panel 176 is adjacent to and faces the door inner surface 180 of the top panel 174, where the hinged door 202 is in the unextended position 190, shown in FIG. 15. Where the hinged door 202 is in the extended position 188, the top panel 174, the middle panel 176, and the bottom panel 178 are all oriented on a same plane, as shown in FIG. 13.

Now referring to FIGS. 1-4, the top stacking module 118 may also include at least one X-shaped raised portion 208. Without being bound to a particular theory, it is believed that the X-shaped raised portion 208 allows the portable structure 100 to have greater structural integrity. It should be appreciated that the portable structure 100 may include additional raised portions (not shown) to provide more structural integrity, as desired.

With reference to FIG. 17, a method 300 for installing the portable structure 100 is shown. The method 300 includes a step 302 of providing the portable structure 100.

Next, the portable structure 100 is transported to a predetermined location (not shown), in a step 304. The portable structure 100 is transported while the plurality of stacking modules 106 are in the collapsed position 112 and the plurality of telescopic beams 104 are in the unlocked position 144. Desirably, this permits the portable structure 100 to be easily carried by hand or transported via a vehicle (not shown).

In a step 306, the portable structure 100 is disposed on the predetermined location. Then, in a step 308, the top stacking module 118 is moved upwardly. Conveniently, the user is able to move the top stacking module 118 without requiring additional tools.

Next, the plurality of telescopic beams 104 are placed in the locked position 146, in a step 310. Advantageously, the locked position 146 supports the plurality of stacking modules 106, militating against the plurality of stacking modules 106 from moving to the collapsed position 112.

It should be appreciated that like or related structure to that found in FIGS. 1-5 is shown in FIGS. 6-10 with the same reference number and a prime (') symbol for purposes of clarity.

As shown in FIGS. 6-10, a portable structure 100' has a main body 102'. The main body 102' includes a plurality of stacking modules 106'. The plurality of stacking modules 106' are configured to move between a collapsed position 112', shown in FIG. 7, and a uncollapsed position 114', shown in FIG. 6. Each of the plurality of stacking modules 106' has an inner surface 108' and an outer surface 110'. The plurality of stacking modules 106' includes a bottom stacking module 116', a top stacking module 118', and a middle stacking module 120'. The bottom stacking module 116' is selectively and slidably disposed within the middle stacking module 120'. The middle stacking module 120' is selectively and slidably disposed within the top stacking module 118'.

Now referencing to FIGS. 6-8 and 10, each of the middle stacking module 120' and the top stacking module 118' may include a plurality of ridges 210' formed on the outer surface 110' with a plurality of corresponding channels 212' formed on the inner surface 108'.

Figure 6:
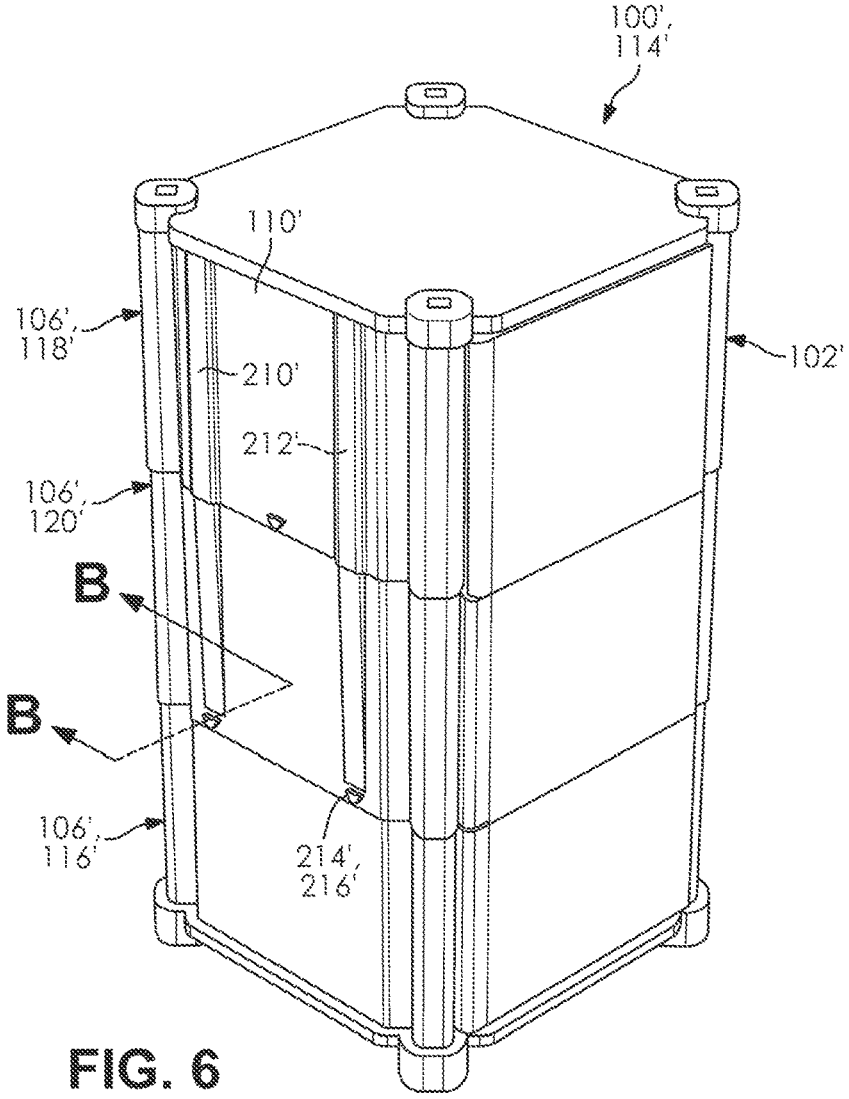
FIG. 6 is a top perspective view of a portable structure, according to another embodiment of the disclosure, and further showing the portable structure in the uncollapsed position with a plurality of ridges and a plurality of locking protrusions.
Figure 7:
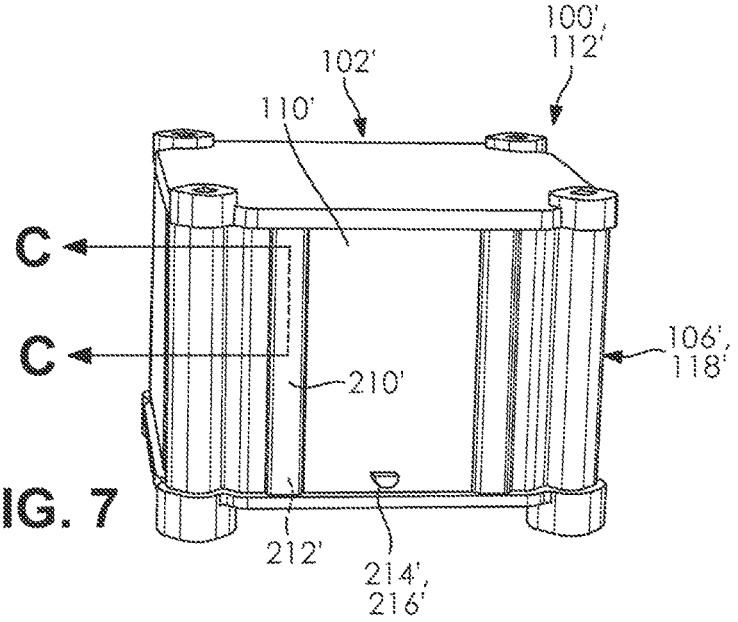
FIG. 7 is a front perspective view of the portable structure shown in FIG. 6, and further showing the portable structure in the collapsed position.
Figure 9:
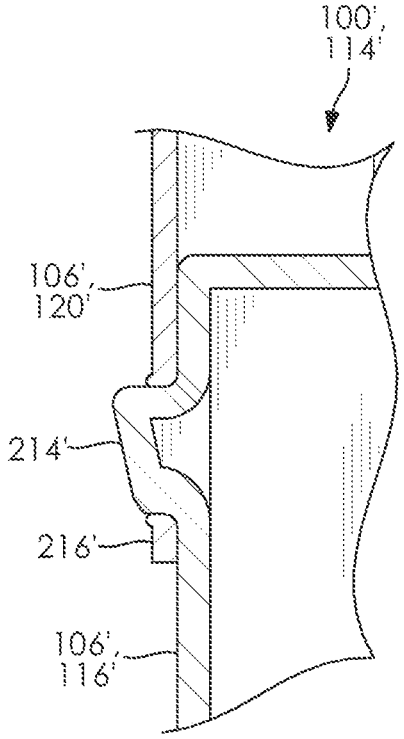
FIG. 9 is a cross sectional side elevational view of the portable structure in the uncollapsed position taken at section line B-B in FIG. 6, and further showing one of the plurality of protrusions disposed through a locking aperture.
Figure 10:
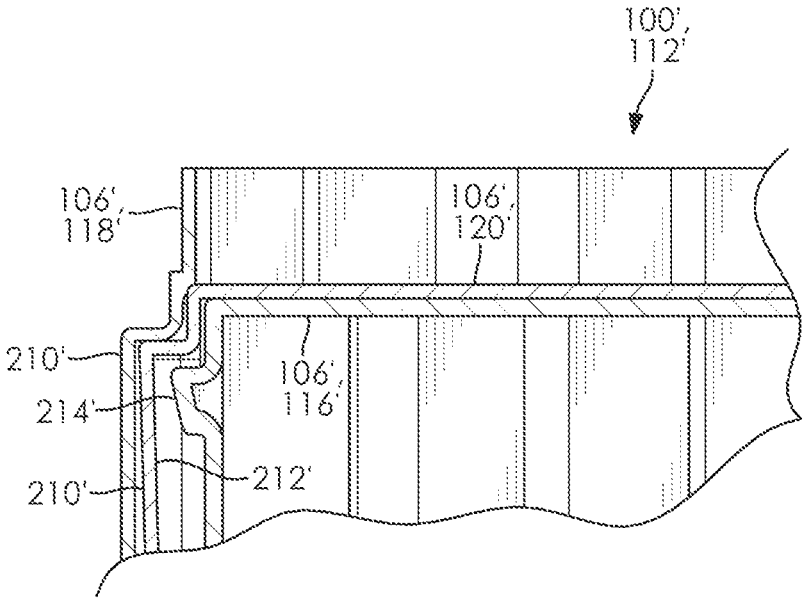
FIG. 10 is a cross sectional side elevational view of the portable structure in the collapsed position with the top cap removed, taken at section line C-C in FIG. 7.

As shown in FIGS. 7 and 10, where the plurality of stacking modules 106' are in the collapsed position 112', the bottom stacking module 116' is nested within the middle stacking module 120' and the middle stacking module 120' is nested within the top stacking module 118'. In addition, each of the plurality of ridges 210' of the middle stacking module 120' are disposed within one of the plurality of corresponding channels 212' of the top stacking module 118', where the plurality of stacking modules 106' are in the collapsed position 112'. As shown in FIGS. 6 and 9, where the plurality of stacking modules 106' are in the uncollapsed position 114' the bottom stacking module 116' is unnested from the middle stacking module 120' and the middle stacking module 120' is unnested from the top stacking module 118'.

Without being bound to a particular theory, it is believed having the cooperation between the plurality of ridges 210' and the plurality of corresponding channels 212' allows for the plurality of stacking modules 106' to be more easily moved between the collapsed position 112' and the uncollapsed position 114'. In some instances, each of the plurality of ridges 210' of the middle stacking module 120' is tapered, shown in FIGS. 6 and 8. It is believed that this also allows the plurality of stacking modules 106' to more easily move between the collapsed position 112' and the uncollapsed position 114'. It should be appreciated that a skilled artisan many scale the number of the plurality of ridges 210' and the plurality of corresponding channels 212', within the scope of this disclosure.

With reference to FIGS. 6-10, the main body 102' may further include a plurality of locking protrusions 214' and a plurality of locking holes 216'. The plurality of locking protrusions 214' are disposed on at least one of the bottom stacking module 116' and the middle stacking module 120'. The plurality of locking holes 216' are formed on the at least one of the middle stacking module 120' and the top stacking module 118'. It should be appreciated that one skilled in the art may scale the number of plurality of locking protrusions 214' and the plurality of locking holes 216', as desired As shown in FIGS. 7 and 10, where the plurality of stacking modules 106' are in the collapsed position 112', each of the plurality of locking protrusions 214' of the bottom stacking module 116' is disposed through one of the plurality of locking holes 216' of the middle stacking module 120'. In addition, each of the plurality of locking protrusions 214' of the middle stacking module 120' is disposed through one of the plurality of apertures 216' of the top stacking module 118', where the plurality of stacking modules 106' are in the collapsed position 112'. Desirably, the plurality of locking protrusions 214' support the plurality of stacking modules 106' and militate against the plurality of stacking modules 106' from moving to the collapsed position 112'.

Advantageously, the portable structure 100, method 200, and the portable structure 100' is easy to install. The user simply needs to move the top stacking module 118 upwardly. Desirably, this can be accomplished without using any external tools. In addition, the plurality of telescopic beams 104 in the locked position 146 militates against the plurality of stacking modules 106 from moving unintentionally into the collapsed position 112, thereby making the portable structure 100 more durable.

While certain representative embodiments and details have been shown for purposes of illustrating the invention, it will be apparent to those skilled in the art that various changes may be made without departing from the scope of the disclosure, which is further described in the following appended claims.

What is claimed is:

1. A portable structure, comprising:

a main body including a plurality of stacking modules configured to move between a collapsed position and an uncollapsed position, each of the stacking modules having an inner surface and an outer surface, the plurality of stacking modules including a bottom stacking module and a top stacking module, the bottom stacking module selectively slidably disposed within the top stacking module, the top stacking module having a plurality of holes formed therethrough, the bottom stacking module nested within the top stacking module when the stacking modules are in the collapsed position, and the bottom stacking module is unnested from the top stacking module when stacking modules are in the uncollapsed position; and a plurality of telescopic beams disposed inside of the main body, each of the telescopic beams having a bottom end attached to the bottom stacking module and a top end attached to the top stacking module, and each of the telescopic beams further disposed through one of the holes formed in the top stacking module, the telescopic beams configured to be placed in an unlocked position and a locked position, the telescopic beams in the unlocked position permitting the stacking modules to be moved to the collapsed position, and the telescopic beams in the locked position supporting the stacking modules in the uncollapsed position, wherein each of the plurality of telescopic beams has a locking aperture, the locking aperture configured to receive a locking pin, and the locking pin configured to permit each of the plurality of telescopic beams to be placed in the locked position where the locking pin is disposed in the locking aperture, wherein each of the stacking modules has a plurality of corners, each of the corners having a corner channel formed on the inner surface, and a plurality of bridge segments, each of the bridge segments disposed across the corner channel of each of the corners.

2. The portable structure of claim 1, wherein each of the plurality of bridge segments have one of the holes formed therethrough.

3. The portable structure of claim 1, wherein each of the plurality of telescopic beams have at least one shelf disposed below each of the plurality of bridge segments, the at least one shelf supporting one of the plurality of bridge segments where the plurality of stacking modules are in the uncollapsed position.

4. The portable structure of claim 1, wherein the main body has a door including a top panel, a middle panel, and a bottom panel.

5. A portable structure, comprising:

a main body including a plurality of stacking modules configured to move between a collapsed position and an uncollapsed position, each of the stacking modules having an inner surface and an outer surface, the plurality of stacking modules including a bottom stacking module and a top stacking module, the bottom stacking module selectively slidably disposed within the top stacking module, the top stacking module having a plurality of holes formed therethrough, the bottom stacking module nested within the top stacking module when the stacking modules are in the collapsed position, and the bottom stacking module is unnested from the top stacking module when stacking modules are in the uncollapsed position; and a plurality of telescopic beams disposed inside of the main body, each of the telescopic beams having a bottom end attached to the bottom stacking module and a top end attached to the top stacking module, and each of the telescopic beams further disposed through one of the holes formed in the top stacking module, the telescopic beams configured to be placed in an unlocked position and a locked position, the telescopic beams in the unlocked position permitting the stacking modules to be moved to the collapsed position, and the telescopic beams in the locked position supporting the stacking modules in the uncollapsed position, wherein each of the plurality of telescopic beams has a locking aperture, the locking aperture configured to receive a locking pin, and the locking pin configured to permit each of the plurality of telescopic beams to be placed in the locked position where the locking pin is disposed in the locking aperture, wherein the main body has a door including a top panel, a middle panel, and a bottom panel, and wherein the middle panel is hingedly attached to the bottom panel via a bottom hinge.

6. The portable structure of claim 5, wherein the top panel is hingedly attached to the middle panel via a top hinge.

7. The portable structure of claim 4, wherein the top panel of the door is attached to the top stacking module via a hinge.

8. A portable structure, comprising:

a main body including a plurality of stacking modules configured to move between a collapsed position and an uncollapsed position, each of the stacking modules having an inner surface and an outer surface, the plurality of stacking modules including a bottom stacking module and a top stacking module, the bottom stacking module selectively slidably disposed within the top stacking module, the top stacking module having a plurality of holes formed therethrough, the bottom stacking module nested within the top stacking module when the stacking modules are in the collapsed position, and the bottom stacking module is unnested from the top stacking module when stacking modules are in the uncollapsed position; and a plurality of telescopic beams disposed inside of the main body, each of the telescopic beams having a bottom end attached to the bottom stacking module and a top end attached to the top stacking module, and each of the telescopic beams further disposed through one of the holes formed in the top stacking module, the telescopic beams configured to be placed in an unlocked position and a locked position, the telescopic beams in the unlocked position permitting the stacking modules to be moved to the collapsed position, and the telescopic beams in the locked position supporting the stacking modules in the uncollapsed position, wherein each of the plurality of telescopic beams has a locking aperture, the locking aperture configured to receive a locking pin, and the locking pin configured to permit each of the plurality of telescopic beams to be placed in the locked position where the locking pin is disposed in the locking aperture, wherein the main body has a door including a top panel, a middle panel, and a bottom panel, wherein the top panel of the door is attached to the top stacking module via a hinge, the middle panel is hingedly attached to the bottom panel via a bottom hinge, and the top panel is hingedly attached to the middle panel via a top hinge.

9. The portable structure of claim 8, wherein the door is movable between an unextended position and an extended position.

10. The portable structure of claim 9, wherein an outer surface of the bottom panel is adjacent to and faces an outer surface of the middle panel, and the middle panel is configured to pivot about the top hinge so that an inner surface of the middle panel is adjacent to and faces an inner surface of the top panel, when the door is in the unextended position.

11. The portable structure of claim 10, wherein the bottom panel, the middle panel, and the top panel are all oriented on a same plane when the door is in the extended position.

12. The portable structure of claim 4, wherein the middle panel is slidably disposed in the top panel, and the bottom panel is slidably disposed in the middle panel.

13. The portable structure of claim 4, wherein the middle panel is nested within the top panel and the bottom panel is nested within the middle panel when the door is in the unextended position, and the middle panel is unnested from the top panel and the bottom panel is unnested from the middle panel when the door is in the extended position.

14. The portable structure of claim 4, wherein the top panel is selectively removably affixed to the middle panel, and the middle panel is selectively removably affixed to the bottom panel, and the top panel is removably and rotatably affixed to a top cap of the main body, and the bottom panel is removably and rotatably affixed to a bottom cap of the main body, whereby the door is permitted to open and close a doorway.

15. The portable structure of claim 1, wherein the top stacking module includes at least one X-shaped raised portion.

16. A method for installing a portable structure, the method comprising the steps of:

providing the portable structure having a main body with a plurality of stacking modules configured to move between a collapsed position and an uncollapsed position, each of the plurality of stacking modules having an inner surface and an outer surface, the plurality of stacking modules including a bottom stacking module and a top stacking module, the bottom stacking module selectively slidably disposed within the top stacking module, the top stacking module having a plurality of holes formed therethrough, the bottom stacking module nested within the top stacking module where the plurality of stacking modules are in the collapsed position, and the bottom stacking module is unnested from the top stacking module where the plurality of stacking modules are in the uncollapsed position, and a plurality of telescopic beams disposed inside of the main body, each of the telescopic beams having a bottom end attached to the bottom stacking module and a top end attached to the top stacking module, and each of the telescopic beams further disposed through one of the holes formed in the top stacking module, the telescopic beams configured to be placed in an unlocked position and a locked position, the telescopic beams in the unlocked position permitting the stacking modules to be moved to the collapsed position, and the telescopic beams in the locked position supporting the stacking modules in the uncollapsed position, wherein each of the plurality of telescopic beams has a locking aperture, the locking aperture configured to receive a locking pin, and the locking pin configured to permit each of the plurality of telescopic beams to be placed in the locked position where the locking pin is disposed in the locking aperture;

transporting the portable structure to a predetermined location where the plurality of stacking modules are in the collapsed position and the telescopic beams are in the unlocked position;

disposing the portable structure on the predetermined location;

moving the top stacking module upwardly; and placing the telescopic beams in the locked position, thereby supporting the stacking modules in the uncollapsed position, wherein the main body has a door including a top panel, a middle panel, and a bottom panel, the middle panel is hingedly attached to the bottom panel via a bottom hinge, the top panel is hingedly attached to the middle panel via a top hinge, and the top panel of the door is attached to the top stacking module via a hinge.

17. The method of claim 16, wherein the door is movable between an unextended position and an extended position.

18. The method of claim 17, wherein an outer surface of the bottom panel is adjacent to and faces an outer surface of the middle panel, and the middle panel is configured to pivot about the top hinge so that an inner surface of the middle panel is adjacent to and faces an inner surface of the top panel, when the door is in the unextended position and the bottom panel, the middle panel, and the top panel are all oriented on a same plane when the door is in the extended position.

* * * * *